US007375456B2

(12) United States Patent
Collins et al.

(10) Patent No.: US 7,375,456 B2
(45) Date of Patent: May 20, 2008

(54) MOUNT FOR HIGH INTENSITY DISCHARGE LAMP

(75) Inventors: Stephen A. Collins, Lowell, MA (US); John A. Scholz, Georgetown, MA (US); Kenneth J. Rochon, Pembroke, NH (US)

(73) Assignee: Osram Sylvania Inc., Danvers, MA (US)

( * ) Notice: Subject to any disclaimer, the term of this patent is extended or adjusted under 35 U.S.C. 154(b) by 216 days.

(21) Appl. No.: 11/095,061

(22) Filed: Mar. 31, 2005

(65) Prior Publication Data

US 2006/0226782 A1 Oct. 12, 2006

(51) Int. Cl.
*H01K 1/58* (2006.01)

(52) U.S. Cl. ..... 313/25; 313/26; 313/27; 439/615; 439/739

(58) Field of Classification Search ..... 313/25, 313/634, 624, 284, 26–27; 439/615, 739
See application file for complete search history.

(56) References Cited

U.S. PATENT DOCUMENTS 5,043,623 A * 8/1991 Scholz et al. ..... 313/25
5,340,346 A 8/1994 Muzeroll
5,550,421 A 8/1996 Scholz et al.
5,576,598 A 11/1996 Zaslavsky et al.
5,998,915 A 12/1999 Scholz et al.
6,628,080 B1 9/2003 McCullough et al.
6,737,791 B2 5/2004 McCullough et al.
6,858,976 B2 * 2/2005 McCullough et al. .. 313/318.09

FOREIGN PATENT DOCUMENTS

EP 1403905 3/2004
EP 1507276 2/2005

* cited by examiner

*Primary Examiner*—Joseph Williams
*Assistant Examiner*—Hana A Sanei
(74) *Attorney, Agent, or Firm*—William E. Meyer

(57) ABSTRACT

The HID lamp mount has a discharge tube with two ends. A shroud surrounds the tube. Shroud clips position the shroud ends. The shroud clips have arcuate portions engaging the shroud periphery and transverse portions spanning the shroud diameter and grasping and positioning the tube ends. A shroud rod attaches between the clips to maintain their positioning. An electrical lead-in connects the second electrode terminus and has a first leg extending transversely from the terminus and a second leg extending parallel to the electrode. An offset electrical lead-in connects the first electrode terminus, and has a first section extending transversely to the first electrode, a second section extending parallel to the shroud, a third section extending toward the shroud, and a fourth section extending parallel to the shroud. An offset electrical lead-in retaining clip is affixed to the shroud and the fourth section of the offset electrical lead-in retaining clip.

4 Claims, 2 Drawing Sheets

MOUNT FOR HIGH INTENSITY DISCHARGE LAMP

TECHNICAL FIELD

This invention relates to lamps and more particularly to arc discharge lamps. Still more particularly, it relates to increased structural stability for arc discharge lamp mounts.

BACKGROUND ART

Mounts for arc discharge lamps generally employ the arc tube itself, a tubular shroud, strapping for supporting the arc tube and shroud and electrical lead-ins for connection to a power source. It is often necessary or expedient to manufacture the various pieces of the lamp, such as the mount, the base and the outer envelope in different locations and ship them to yet another location for final assembly into a lamp. It is important to maintain the tolerances and the electrode positioning built into the mount during shipping so that automated assembly of the mount to the lamp envelope can easily be accomplished. The automated assembly includes the step of inserting the electrical lead-ins into ferrules that are sealed into a lamp envelope. Because one of the electrical lead-ins is generally much longer than the other, it has been difficult to maintain the desired spacing integrity between the lead-ins during packaging, shipping, unpacking and assembly.

DISCLOSURE OF INVENTION

It is, therefore, an object of the invention to obviate the disadvantages of the prior art.

It is another object of the invention to enhance the structural integrity of arc discharge mounts.

These objects are accomplished, in one aspect of the invention, by a mount for a high intensity discharge lamp comprising: an arc discharge tube having a central body with first and second opposed ends; a first electrode in said first end and a second electrode in said second end, said first electrode projecting into said central body and having a first electrode terminus extending from said first end, said second electrode projecting into said central body and having a second electrode terminus extending from said second end; an arc generating and sustaining medium in said body; a tubular shroud surrounding said arc discharge tube; two shroud clips, one positioned at each end of said tubular shroud, each shroud clip comprising an arcuate portion engaging the periphery of said tubular shroud and a transverse portion spanning the diameter of said tubular shroud and grasping and positioning one of said first and second ends of said arc tube; an electrical lead-in connected to said second electrode and extending therefrom; an offset electrical lead-in connected to said first electrode, said offset electrical lead-in comprising a first section extending transversely to said first electrode, a second section extending parallel to said tubular shroud, a third section extending toward said tubular shroud, and a fourth section extending parallel to said shroud; and an offset electrical lead-in retaining clip affixed to said shroud and said fourth section of said offset lead-in retaining clip.

The retaining clip that is attached to the shroud and the fourth section of the offset electrical lead-in maintains the critical spacing between the electrical lead-ins during packing, shipping, unpacking and assembly into a lamp.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
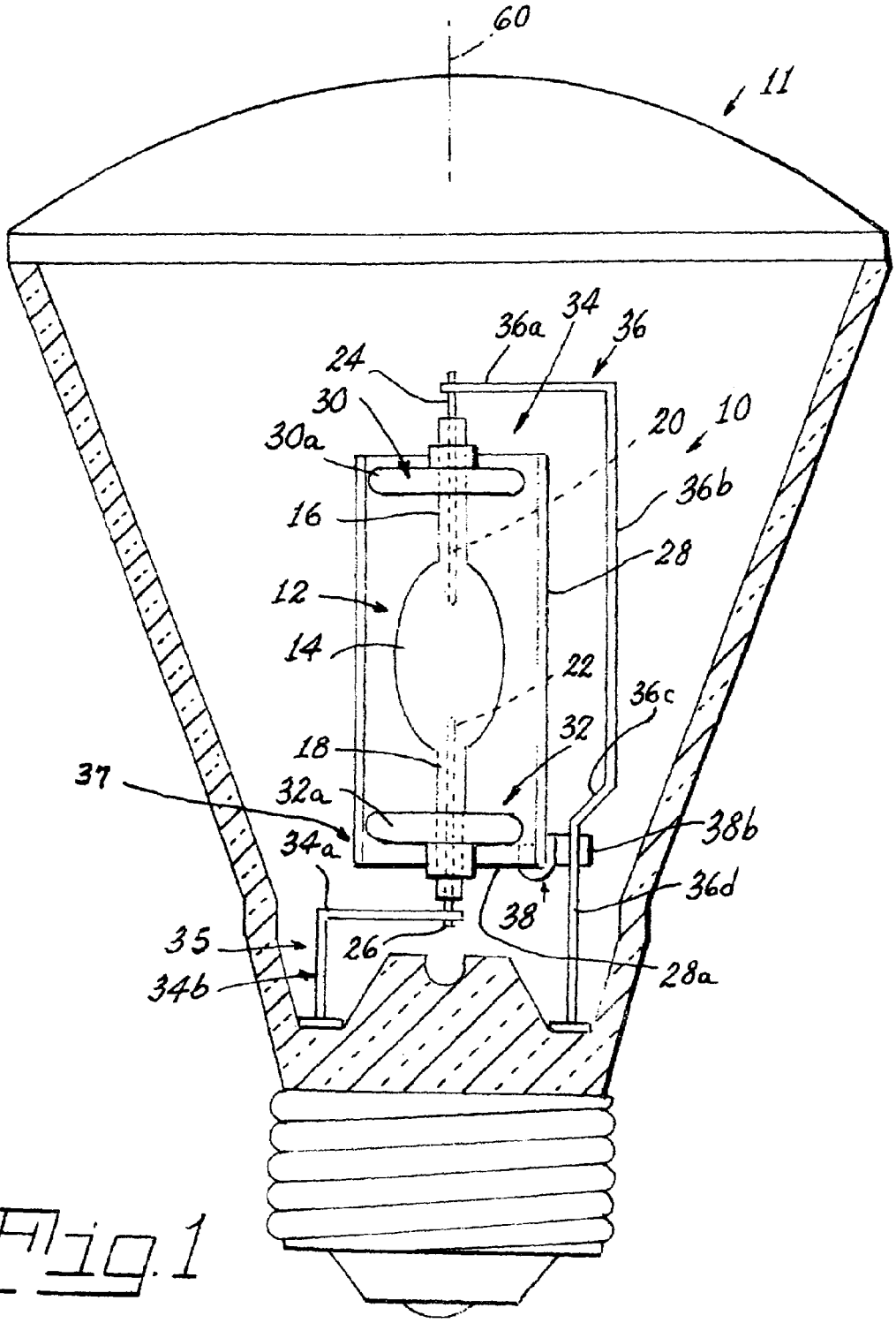
FIG. 1 is a diagrammatic view illustrating an embodiment of the invention.

Referring now to the drawings with greater particularity, there is shown in FIG. 1 a mount 10 for a high intensity discharge lamp 11. The mount 10 comprises an arc discharge tube 12 having a central body 14 with first and second opposed ends 16, 18. A first electrode 20 is fitted into the first end 16 and a second electrode 22 is fitted into the second end 18. The first electrode 20 projects into the central body 14 and has a first electrode terminus 24 extending from the first end 16, and the second electrode 22 projects into the central body 14 and has a second electrode terminus 26 extending from the second end 18. As is conventional, an arc generating and sustaining medium is provided within the body.

Figure 4:
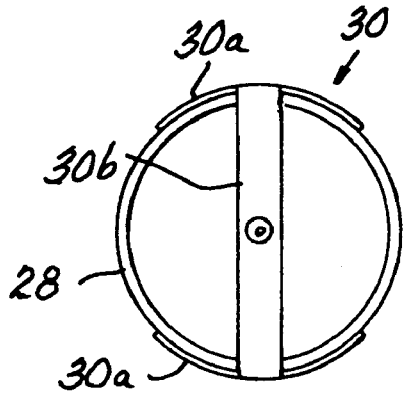
FIG. 4 is a plan view of shroud and shroud clip.
Figure 3:
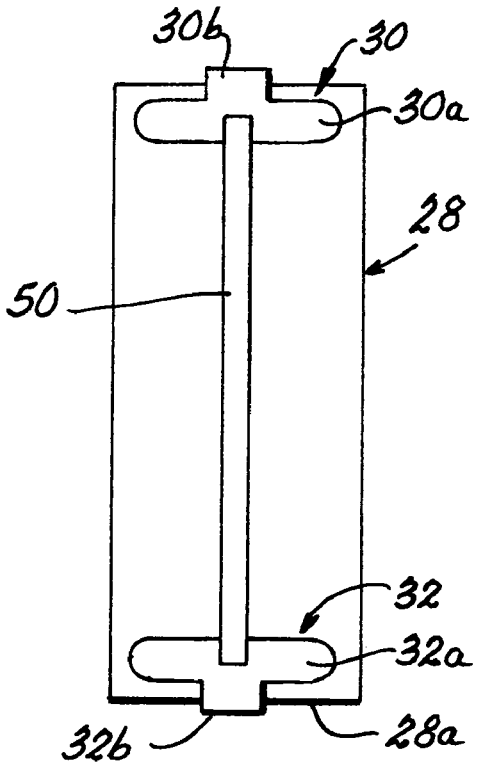
FIG. 3 is an elevational view of a shroud with shroud clips installed and a shroud rod for maintaining the shroud clips.

A tubular shroud 28, for example, of quartz or glass, surrounds the arc discharge tube 12. Two shroud clips 30, 32 are provided, one positioned at each end 34, 37 of the tubular shroud 28. Each shroud clip comprises an arcuate portions 30*a*, 32*a* that engage the periphery of the tubular shroud and a transverse portion 30*b* shown in FIG. 4, that spans the diameter of the tubular shroud 28 and grasps and positions respectively the first and second ends 16, 18 of the arc tube 12. A shroud rod 50 is attached between the shroud clips 30, 32, as by welding, and maintains their positioning. An electrical lead-in 35 is connected to the second electrode terminus 26 and has a first leg 34*a* extending transversely from the terminus 26 and a second leg 34*b* extending parallel to the electrode 22; i.e., parallel to a longitudinal axis 60 of the mount 10.

An offset electrical lead-in 36 is connected to the first electrode terminus 24, and comprises a first section 36*a* extending transversely to the first electrode terminus 24, a second section 36*b* extending parallel to the tubular shroud 28, a third section 36*c* extending toward the tubular shroud 28, and a fourth section 36*d* extending parallel to the shroud.

An offset electrical lead-in retaining clip 38 is affixed to the shroud 28 and the fourth section 36*d* of the offset electrical lead-in 36.

Figure 2:
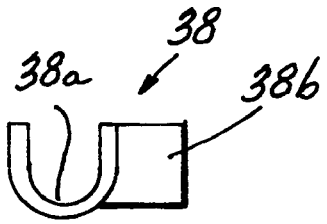
FIG. 2 is an elevational view of a retaining clip.

The offset electrical lead-in retaining clip 38 is shown more clearly in FIG. 2 and has a U-shaped portion 38*a* that is attached to an edge 28*a* of the tubular shroud 28 and has an integrally formed flag 38*b* that is attached to the fourth section 36*d* of the offset electrical lead-in 36, preferably by welding. A preferred material for the clip 38 is annealed stainless steel having a thickness of about 0.026 inches and the clip 38 is preferably folded from a single piece of material.

The addition of the offset electrical lead-in retaining clip 38 securely fixes the desired position of the offset electrical lead-in and maintains its desired position during packing, shipping, unpacking, and subsequent assembly into a lamp.

While there have been shown and described what are present considered to be the preferred embodiments of the invention, it will be apparent to those skilled in the art that various changes and modifications can be made herein without departing from the scope of the invention as defined by the appended claims.

What is claimed is:

1. A mount for a high intensity discharge lamp comprising:

an arc discharge tube having a central body with first and second opposed ends;

a first electrode in said first end and a second electrode in said second end, said first electrode projecting into said central body and having a first electrode terminus extending from said first end, said second electrode projecting into said central body and having a second electrode terminus extending from said second end;

an arc generating and sustaining medium in said body;

a tubular shroud surrounding said arc discharge tube;

two shroud clips, one positioned at each end of said tubular shroud, each shroud clip comprising an arcuate portion engaging the periphery of said tubular shroud and a transverse portion spanning the diameter of said tubular shroud and grasping and positioning one of said first and second ends of said arc tube;

an electrical lead-in connected to said second electrode and extending therefrom;

an offset electrical lead-in connected to said first electrode, said offset electrical lead-in comprising a first section extending transversely to said first electrode, a second section extending parallel to said tubular shroud, a third section extending toward said tubular shroud, and a fourth section extending parallel to said shroud; and an offset electrical lead-in retaining clip affixed to said shroud and said fourth section of said offset lead-in retaining clip, said offset electrical lead-in retaining clip being separate from and unattached to, said shroud clips.

2. The mount of claim 1 wherein said offset lead-in retaining clip has a U-shaped portion attached to an edge of said tubular shroud.

3. The mount of claim 2 wherein said U-shaped portion has an integrally formed flag.

4. The mount of claim 3 wherein said integrally formed flag is attached to said fourth section of said offset electrical lead-in.

* * * * *